US005515759A

United States Patent [19]

Geoghegan

[11] Patent Number: 5,515,759

[45] Date of Patent: May 14, 1996

[54] HYDRAULIC PEDAL MECHANISM FOR PIANOS

[76] Inventor: Daniel Geoghegan, 14546 W. Dixie Hwy., Miami, Fla. 33161

[21] Appl. No.: 341,780

[22] Filed: Nov. 18, 1994

[51] Int. Cl.[6] ..... G10C 3/26; G10F 1/02

[52] U.S. Cl. ..... 84/225; 84/21; 84/23; 84/19

[58] Field of Search ..... 84/225, 19, 21, 84/33, 34, 35, 23

[56] References Cited

U.S. PATENT DOCUMENTS

| | | | |
|---|---|---|---|
| 4,206,677 | 6/1980 | Ramsey | 84/23 |
| 5,016,513 | 5/1991 | Stahnke | 84/19 |
| 5,335,574 | 8/1994 | Matsunaga et al. | 84/21 |

*Primary Examiner*—Cassandra C. Spyrou

[57] ABSTRACT

A mechanism for hydraulically actuating a damper assembly in pianos. It includes first, second and third cylinder assemblies interconnected to permit a user to selectively play a piano or use a computer with a suitable interface. The pedal mechanism is coupled to the first cylinder assembly so that the first rod associated with the first piston head moves the hydraulic fluid into the second cylinder assembly which in turn pushes second rod out to release the damper head holding a piano string. Alternatively, the piano can be played with a computer with a solenoid interface that causes the hydraulic fluid inside the third cylinder assembly to go inside the second cylinder assembly or first cylinder assembly causing the same effect as if it was done by activating a pedal. Conduit members connect the different cylinders without causing any incompatibility or interference.

6 Claims, 3 Drawing Sheets

HYDRAULIC PEDAL MECHANISM FOR PIANOS

BACKGROUND OF THE INVENTION

1. Field of the Invention

The present invention relates to a hydraulic pedal mechanism for pianos, and more particularly, to such a mechanism that is selectively manually or computer actuated.

2. Description of the Related Art

Several mechanisms have been used in the past to interface with computer systems that automatically play a piano. However, many times these mechanisms are incompatible with the conventional manner of playing a piano. Also, these mechanisms are cumbersome to install requiring many moving parts. The use of a hydraulic circuit in this invention avoids such incompatibility and it is easier to install.

SUMMARY OF THE INVENTION

It is one of the primary objects of the present invention to provide a hydraulic pedal mechanism that can be selectively actuated directly by a user's foot or by a computer driven interface.

It is an object of the present invention to provide a hydraulic pedal mechanism that can be installed in a minimum time and with a minimum of parts.

It is another object of the present invention to provide a pedal mechanism that permits a piano to be played in a conventional manner.

It is still another object of the present invention to provide a mechanism that permits users who cannot reach the floor pedals to play a piano.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
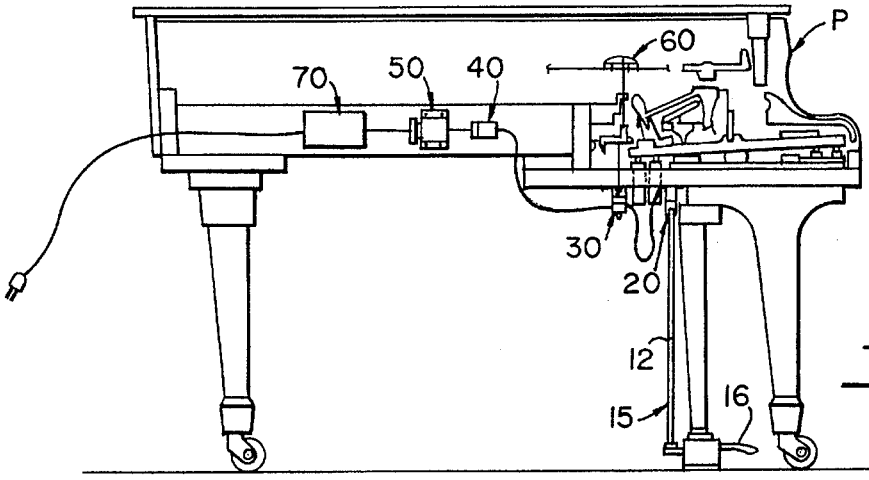
FIG. 1 is a representation of the main internal components of a piano with the preferred embodiment of the present invention incorporated therein.

Referring now to the drawings, where the present invention is generally referred to with numeral 10, it can be observed that it basically includes pedal assembly 15, first cylinder assembly 20, second cylinder assembly 30, third cylinder assembly 40, solenoid assembly 50, piano damper assembly 60 and computer system 70. A user conventionally plays a piano and actuates, as needed, pedal assembly 15, as seen in FIG. 1. Or, piano P can be played by a computer that is pre-programmed to provide the necessary outputs to drive solenoid assembly 50. These two alternatives for playing piano P are compatible with each other, that is, they do not interfere in any way with each other.

Figure 2:
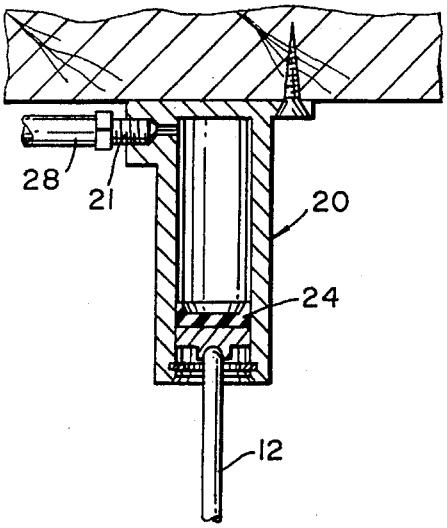
FIG. 2 shows a cross-sectional elevational view of the first hydraulic cylinder.
Figure 3:
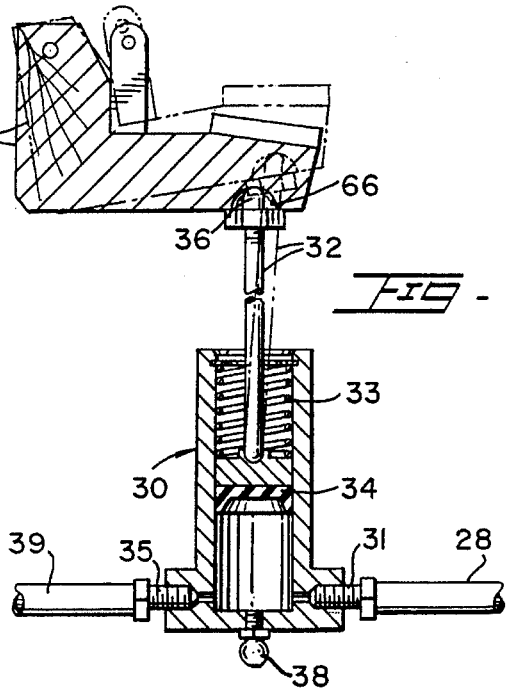
FIG. 3 illustrates a cross-sectional elevational view of the second hydraulic cylinder.
Figure 4:
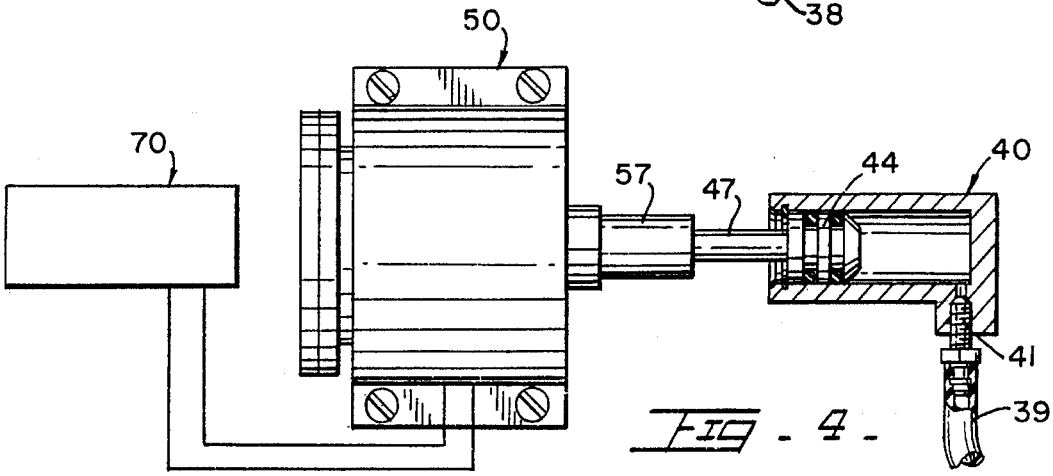
FIG. 4 is a representation of a cross-sectional elevational view of the third hydraulic cylinder.
Figure 5:
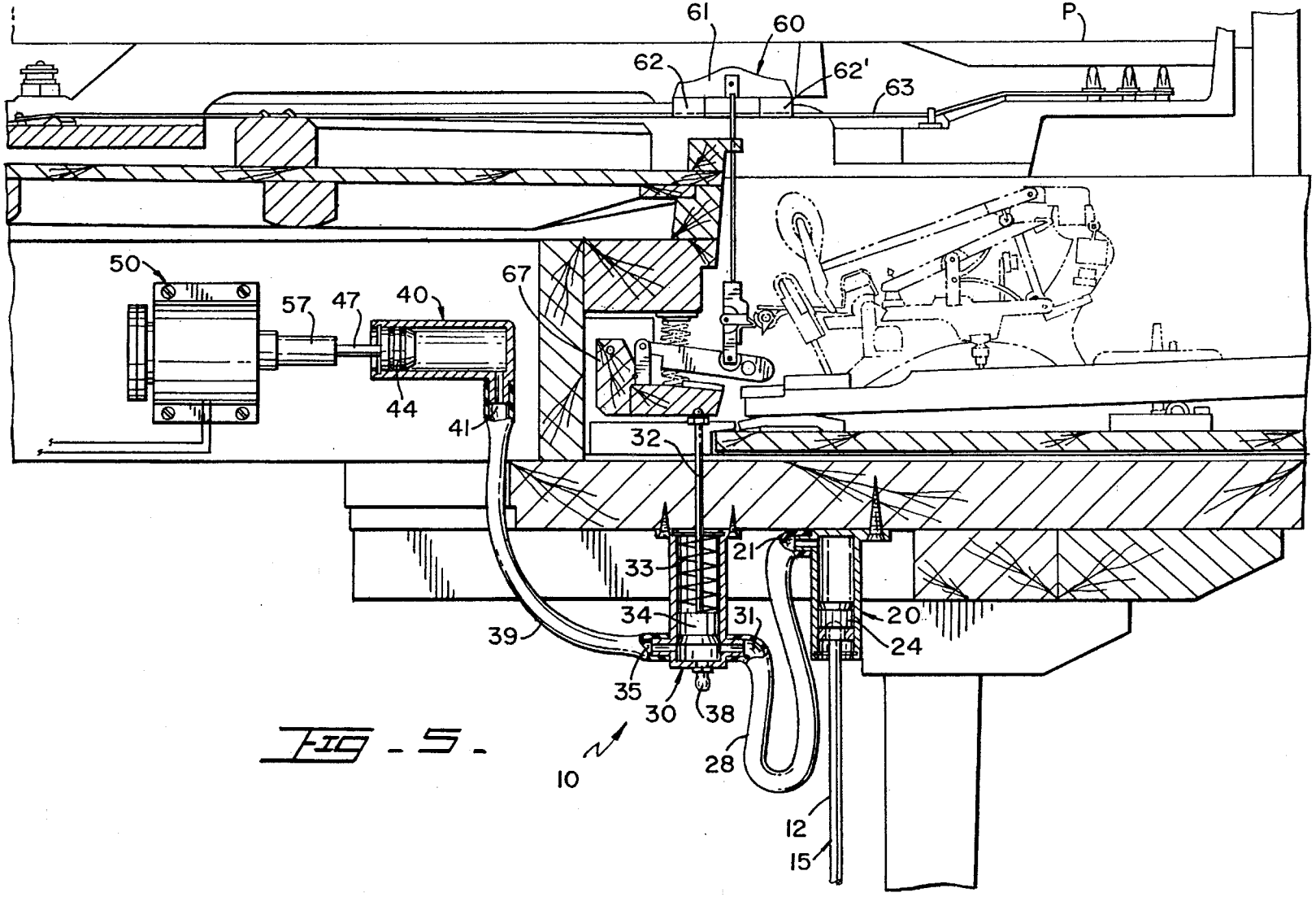
FIG. 5 is an enlarged elevational view of the main components affected by the incorporation of the mechanism subject of the present application.

As shown in FIGS. 1, 2 and 5, the movement of pedal member 16 of pedal assembly 15 is transmitted to first rod 12 connected to first piston head 24 actuating first cylinder assembly 20. First cylinder assembly 20 is mounted to the underside of piano P, in the preferred embodiment. Port member 21 of first cylinder assembly 20 is connected to port member 31 of second cylinder assembly 30 through conduit member 28. Once the player pushes down pedal member 16, first rod 12 transmits the movement upwardly and the hydraulic fluid is urged in the same direction. In this manner, the volume of the hydraulic fluid in first cylinder assembly 20 minimizes, thereby maximizing its volume in second cylinder assembly 30. The increase of the hydraulic fluid in second cylinder assembly 30 urges upwardly second piston head 34. Second rod 32 is connected to second piston head 34 and transmits the movement to piano damper assembly 60, which operates in a conventional manner. In the preferred embodiment, piano damper assembly 60 includes pivoting L-shaped member 67 that transmits the movement through a number of pivoting linkages and finally to damper head 61 and damper felt members 62 and 62'. The end result being the release of string 63 with the consequent musical effect. This is a conventional mechanism in pianos. A suitable hydraulic fluid is used, such as water. In the preferred embodiment, water and soluble anti-rust oil is used as a fluid. Also, an anti-freezer can be added to prevent damage when instrument is transported in temperatures below the freezing point. In the preferred embodiment, spring member 33 biases second piston head 34 causing it to bring second rod 32 back down when the force applied by a user is released from pedal member 16. Second rod 32 has rounded termination 36 that is received within cavity 66 in pivoting L-shaped member 67 of piano damper assembly 60. As it can be best seen in FIG. 3, termination 36 pushes upwardly against cavity 66 where it is housed. When pedal member 16 is released, piano damper assembly 60 pushes second rod 32 downwardly by gravity. Also, the action of spring member 33 urges second rod 32 downwardly.

Inlet valves 38 and 38' allow a user to replenish any hydraulic fluid that is lost over time. These losses occur as a result of the wear and tear of the sealing elements of the cylinders and piston heads. Inlet valves 38 and 38' can be located in a suitable place in the fluid circuit.

When hydraulic pedal mechanism 10 is driven by computer system 70, the latter is pre-programmed to provide a suitable output signal to drive piano damper assembly 60. A computer output signal is fed to solenoid assembly 50 which in turn responds through a reciprocal movement that activates third cylinder assembly 40. Solenoid rod 57 is mechanically connected to third piston rod 47, thereby transmitting the mechanical movement originated by the programmed computer. In the preferred embodiment, rod 47 is threaded and screwed to rod 57 so that by turning rod 47 the displacement of piston head 44 can be adjusted. In this manner, if there is fluid leakage rod 47 can be adjusted to compensate it. In this case, activated third cylinder assembly 40 plays under the same operating principle as first cylinder assembly 20. Third piston rod 47 is connected to third piston head 44 and transmits the movement to piano damper assembly 60. Third cylinder assembly 40 is connected to second cylinder assembly 30 through conduit member 39. Conduit member 39, in the same manner, connects port members 35 and 41 of assemblies 30 and 40, respectively.

In operation, second cylinder assembly 30 acts as a coupler for assemblies 20 and 40, which are activated in a mutually exclusive or alternative manner.

Figure 6:
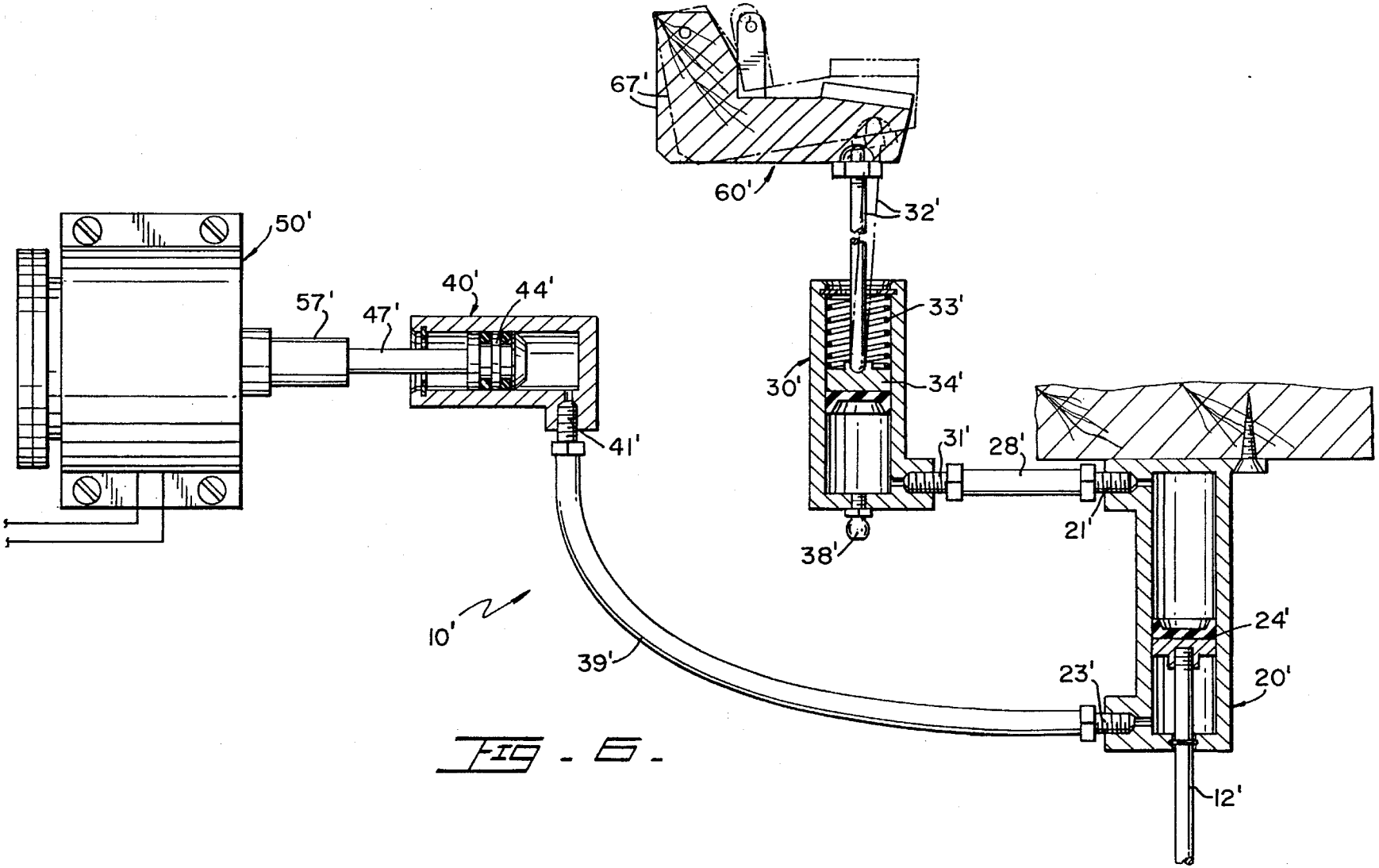
FIG. 6 represents an cross-sectional elevational view of an alternative of the hydraulic mechanism.

In FIG. 6 alternate embodiment 10' is shown, wherein double action hydraulic cylinder assembly 20' is used. It differs from cylinder assembly 20 in that it includes ports 21' and 23'. In this manner, the hydraulic fluid injected in port 23' will cause piston head 24' to move up. Alternatively, a user actuates rod 12' and also moves piston head 24' up. This alternate embodiment has the advantage of causing rod 12' to be moved by the actions of solenoid assembly 50' as transmitted through its rod 57' and third piston rod 47' to push piston head 44'. This causes the pedals of a piano P to move when the computer plays and helps piano students. Second cylinder assembly 30' has only one port 31' that hydraulically connects with port 21' through conduit member 28'. Spring 33' urges rod member 32' and piston head 34' downwardly along with the weight of pivoting L-shaped member 67' of piano damper assembly 60'. Third cylinder assembly 40' remains the same as assembly 40 and it is now connected to assembly 20' through conduit member 39' connected to port 41'.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A hydraulic pedal mechanism for pianos having a damper assembly for releasing piano strings in response to a user's actions on pedal means and said damper assembly including an actuating pivoting member, comprising:

A. first hydraulic cylinder assembly having a first piston head, a first port and a first rod member with first and second ends, and said first end being mechanically connected to said pedal means and said second end being connected to said first piston head so that a user's action applied to said pedal means are transmitted to said first piston head;

B. first conduit assembly having first and second ends and said first end being connected to said first port;

C. second hydraulic cylinder assembly having a second piston head, second and third ports, and second rod member with two ends and one of the ends of said second rod member being in contact with and supporting said actuating pivoting member and the other end of said second rod member being mechanically connected to said second piston head, and said second port being connected to the other end of said first conduit assembly;

D. third hydraulic cylinder assembly having a third piston head, a fourth port, and third rod member with two ends and one of the ends of said third rod member being mechanically connected to said third piston head;

E. second conduit assembly having third and fourth ends and said third end being connected to said third port and said fourth end being connected to said fourth port, thereby forming a closed hydraulic circuit;

F. solenoid assembly having a solenoid rod with a protruding end mechanically connected to the other end of said third rod member, and said solenoid assembly including electrical input means; and G. computer means having an output connected to said electrical input means and said computer means further including storage and programming means so that processing steps can be preprogrammed to cause a number of pre-determined output signals to actuate said solenoid assembly.

2. The hydraulic pedal mechanism set forth in claim 1 wherein said second hydraulic cylinder assembly includes spring means that is cooperatively mounted therein to urge said second head towards a predetermined position.

3. The hydraulic pedal mechanism set forth in claim 2 further including:

H. means for changing a volume of hydraulic fluid within said hydraulic circuit.

4. A hydraulic pedal mechanism for pianos having a damper assembly for releasing piano strings in response to a user's actions on pedal means and said damper assembly including an actuating pivoting member, comprising:

A. first hydraulic double-action cylinder assembly having a first piston head, first and second ports and a first rod member with first and second ends and said first end being mechanically connected to said pedal means and said second end being connected to said first piston head so that a user's action applied to said pedal means are transmitted to said first piston head;

B. first conduit assembly having first and second ends and said first end being connected to said first port;

C. second hydraulic cylinder assembly having a second piston head, third port, and second rod member with two ends and one of the ends of said second rod member being in contact with and supporting said actuating pivoting member and the other end of said second rod member being mechanically connected to said second piston head, and said third port being connected to the other end of said first conduit assembly;

D. third hydraulic cylinder assembly having a third piston head, a fourth port, and third rod member with two ends and one of the ends of said third rod member being mechanically connected to said third piston head;

E. second conduit assembly having third and fourth ends and said third end being connected to said second port and said fourth end being connected to said fourth port, thereby forming a closed hydraulic circuit;

F. solenoid assembly having a solenoid rod with a protruding end mechanically connected to the other end of said third rod member, and said solenoid assembly including electrical input means; and G. computer means having an output connected to said electrical input means and said computer means further including storage and programming means so that processing steps can be pre-programmed to cause a number of pre-determined output signals to actuate said solenoid assembly.

5. The hydraulic pedal mechanism set forth in claim 4 wherein said second hydraulic cylinder assembly includes spring means that are cooperatively mounted therein to urge said second head towards a predetermined position.

6. The hydraulic pedal mechanism set forth in claim 5 further including:

H. means for changing a volume of hydraulic fluid within said hydraulic circuit.

* * * * *